US006564970B1

(12) United States Patent
Walch et al.

(10) Patent No.: US 6,564,970 B1
(45) Date of Patent: May 20, 2003

(54) DISPOSABLE SELF-OPENER FOR OPENING A TUBULAR BAG-CARTRIDGE AND FOR PRESSING OUT A PASTY MATERIAL FROM THE LATTER

(75) Inventors: Roger Walch, Dietlikon (CH); Fritz Seelhofer, Lindau (CH)

(73) Assignee: Createchnic AG, Nurensdorf (CH)

( * ) Notice: Subject to any disclaimer, the term of this patent is extended or adjusted under 35 U.S.C. 154(b) by 0 days.

(21) Appl. No.: 10/018,903

(22) PCT Filed: Mar. 24, 2000

(86) PCT No.: PCT/CH00/00176

§ 371 (c)(1),
(2), (4) Date: Apr. 26, 2002

(87) PCT Pub. No.: WO00/76676

PCT Pub. Date: Dec. 21, 2000

(30) Foreign Application Priority Data

Jun. 15, 1999 (CH) ..... 1111/99

(51) Int. Cl.[7] ..... B05C 17/00

(52) U.S. Cl. ..... 222/82; 222/95; 222/327; 222/386

(58) Field of Search ..... 222/81, 82, 86, 222/95, 325, 326, 327, 386; 239/271, 272

(56) References Cited

U.S. PATENT DOCUMENTS 1,965,271 A * 7/1934 Wharton ..... 222/390
2,733,836 A * 2/1956 Switzer ..... 222/82
5,161,715 A * 11/1992 Giannuzzi ..... 222/82
5,301,839 A * 4/1994 Eierle et al. ..... 222/327
5,368,206 A * 11/1994 Sandrin ..... 222/326
5,697,524 A * 12/1997 Sedlmeier ..... 222/82
5,897,028 A * 4/1999 Sauer ..... 222/82
6,012,610 A * 1/2000 Pauser et al. ..... 222/82
6,223,941 B1 * 5/2001 Nealey ..... 222/82
6,299,022 B1 * 10/2001 Bublewitz et al. ..... 222/326

FOREIGN PATENT DOCUMENTS

| | | |
|---|---|---|
| DE | 43 16 807 A1 | 11/1994 |
| EP | 0 653 362 A1 | 5/1995 |
| GB | 1118355 | 7/1968 |
| WO | WO 97/25155 A1 | 7/1997 |

* cited by examiner

*Primary Examiner*—Kenneth Bomberg
(74) *Attorney, Agent, or Firm*—Edwin D. Schindler

(57) ABSTRACT

A disposable self-opener apparatus for opening a tubular bag cartridge and squeezing a pasty composition therefrom includes a conical tube shoulder having an orifice, with the conical tube shoulder, preferably, made by a plastic injection molding procedure. A self-opener device is able to be screwed with the screw cap for joining the self-opener device with said one end of a tube portion of the conical tube shoulder. The self-opener device has gable-shaped pairs of cutting edges on an inner side thereof with the peaks of the gable-shaped pairs of cutting edges pointing in the direction of screwing. A retainer basket for receiving a metal clip of a tubular bag cartridge to be opened is centrally located on the inner side of the self-opener device, so that the metal clip does not enter a nozzle attached to the orifice of the conical tube shoulder for dispensing the pasty composition, thereby preventing the metal clip from obstructing the flow of the pasty composition through the nozzle.

13 Claims, 3 Drawing Sheets

DISPOSABLE SELF-OPENER FOR OPENING A TUBULAR BAG-CARTRIDGE AND FOR PRESSING OUT A PASTY MATERIAL FROM THE LATTER

BACKGROUND OF THE INVENTION

1. Technical Field of the Invention

The invention relates to a disposable self-opener for first opening a tubular bag cartridge and for subsequently squeezing the pasty compound contained therein from the cartridge. Such pasty compounds are used for sealing or gluing joints and have to be squeezed for that purpose through a nozzle onto the site of application. The pasty compound, whether a sealing compound or an adhesive, is packaged in small quantities in disposable plastic cartridges, which are designed in the form of cylinders, whereby the nozzle is mounted at the front end of the cylinder. A plunger can then be pushed into the cylinder from the back, so that the compound is squeezed out through the nozzle. In the case of larger packaging units, plastic one-way cartridges are not suitable because this would create excessively large amounts of waste. Furthermore, plastic is an unsuitable packaging material for many of such pasty products, because the products are poorly durable in plastics. However, an aluminum foil material, or merely a foil coated with aluminum or with aluminum vapors forms a reliable oxygen, light and moisture barrier and assures practically unlimited durability and thus an unlimited shelf life for the products to be packaged. Therefore, many of such pasty products, for example adhesive compound for gluing-in automobile glass panes, or sealing compounds of the type processed in large quantities especially in the field of construction, are commonly packaged in such foil material-like "sausages" so as to obtain so-called tubular bag cartridges. Exactly as is done with sausages, the two ends are sealed with metal clips. Such pasty compounds packaged like sausages are offered in "sausage" sizes of about 10 mm to 100 mm diameter and up to about 50 cm length. To apply the content, such a "sausage" is inserted in a dispenser device substantially forming a hollow cylinder. A nozzle with a self-opener positioned in front of it can be screwed onto the front side of said cylinder, and a plunger can then be inserted from the back side of said cylinder. Pressure is then directly applied to the foil material from the back end of the "sausage" . In the disposable case, the nozzle is screwed onto a so-called self-opener, which in turn is inserted in a screw cap and subsequently screwed onto the cylinder end of the dispensing device. Before pasty compounds can be squeezed out, the sausage-like tubular bag cartridge has to be opened after it is inserted in the dispensing device. This occurs as the self-opener is being screwed on because it is also produced in the form of a disposable, plastic injection-molded part, provided on the inside with cutting edges, so that the foil on the front side of the packaging, i.e. at the end of the "sausage", is cut open as the self-opener is being screwed on. Under the pressure applied by the plunger, the pasty compound then squeezes through the slits so formed and displaces the foil material sideways. After the pasty compound has been consumed, the foil packaging is removed from the dispenser device and disposed of together with the self-opener and the nozzle.

2. Description of the Prior Art

With the self-openers known heretofore for cutting open the cartridge and mounting the nozzle, it was found to be a drawback that the metal clip of the sausage-like tubular bag cartridge and foil material suspended thereon may tear off under the influence of the flowing pasty compound, and may finally get caught in the opening of the nozzle, where it partly clogs the cross section of the nozzle. With such a partly clogged passage, the compound now exits in the form of a thin "worm" having, for example one fourth of the normal diameter. As this requires particularly high plunger pressure and the pressure is to some extent stored in the front part of the pasty compound, the discharge of the compound can no longer be precision-controlled. Once the pressure of the plunger has been relieved, a "worm" of pasty compound will continue to exit from the nozzle for a certain period of time. In other words, it is no longer possible to rapidly stop the discharge of the paste. In the worst case, the metal clip torn loose may even clog the nozzle, so that the remaining content of the tubular bag cartridge can no longer be squeezed out and is lost.

SUMMARY OF THE INVENTION

Therefore, the problem of the present invention is to create a disposable self-opener that overcomes the drawbacks specified above and permits safe opening of sausage-like tubular bag cartridges containing pasty products, as well as well-dosed and complete squeezing-out of such products by means of a customary dispensing device.

Said problem is solved by a disposable self-opener for opening a tubular bag cartridge and squeezing out a pasty compound therefrom. Said disposable self-opener is comprised of a conical tube shoulder with an orifice, which is produced by injection-molding plastic, whereby the self-opener can be inserted in an associated screw cap and thus screwed onto the end of a tube. On its inner side, the self-opener has gable-shaped pairs of cutting edges with the peak of the gable pointing in the screwing direction. Said self-opener is characterized in that a retainer basket for receiving the metal clip of the tubular bag cartridge to be opened is arranged on its inner side in the center.

BRIEF DESCRIPTION OF THE DRAWING FIGURE

Different views of an exemplified embodiment of the disposable self-opener are shown in the drawings, and the self-opener is explained and its mode of operation is described in the following with the help of said drawings. In the drawings, FIG. 1 shows the outside of the disposable self-opener viewed from the side.

DETAILED DESCRIPTION OF THE DRAWING FIGURE AND PREFERRED EMBODIMENTS

Figure 1:
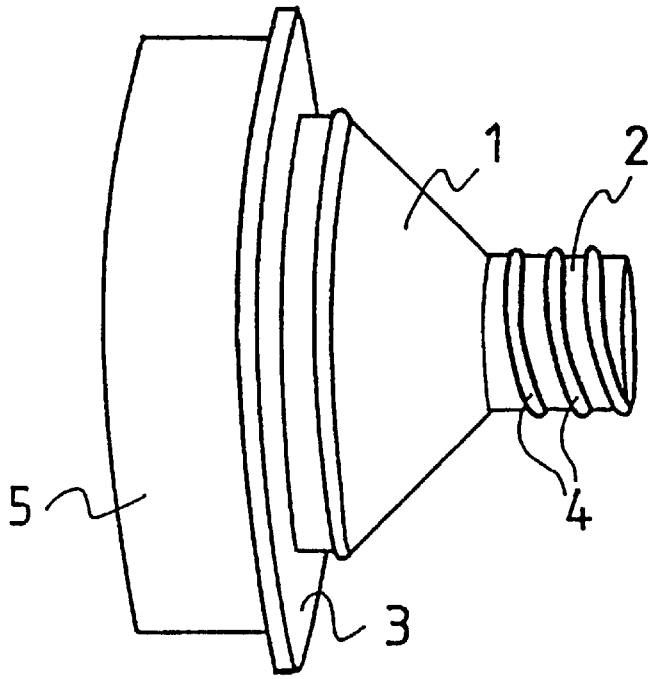

In FIG. 1, the disposable self-opener is first shown from the outside, notably as seen from one side. The self-opener as a whole is produced as a disposable product by plastic injection molding in one production step. It substantially forms a tube shoulder 1 with the orifice 2, whereby the self-opener can be inserted in a screw cap not shown here. In the figure shown, such a screw cap is concentrically turned inside out over the self-opener from the right to the left. The self-opener comprises a flat shoulder 3, which extends all around in the plane of rotation, and the screw cap turned inside out rests on said shoulder. With its inside thread, the screw cap with the self-opener inserted in it is then screwed to the end of atube having an external thread. The commonly used dispenser devices normally comprise a hollow cylinder or a tube that is open on both sides. The pasty compound including the tubular bag cartridge can then be pushed into said tube. For its application as a disposable product, the self-opener shown here is screwed onto said end of the tube with the side shown on the left in the figure. As it is being screwed on, the foil-type tubular bag cartridge is simultaneously cut open by special cutting edges arranged on the inner side of the self-opener. The flat shoulder 3 is adjoined by a ring wall 5, whose function is explained farther below. On the right-hand side in the figure, the tube shoulder 1 formed by the self-opener extends conically in the direction of an orifice 2, which has an outer thread 4, to which a nozzle suitable for the specific given application can be screwed.

Figure 2:
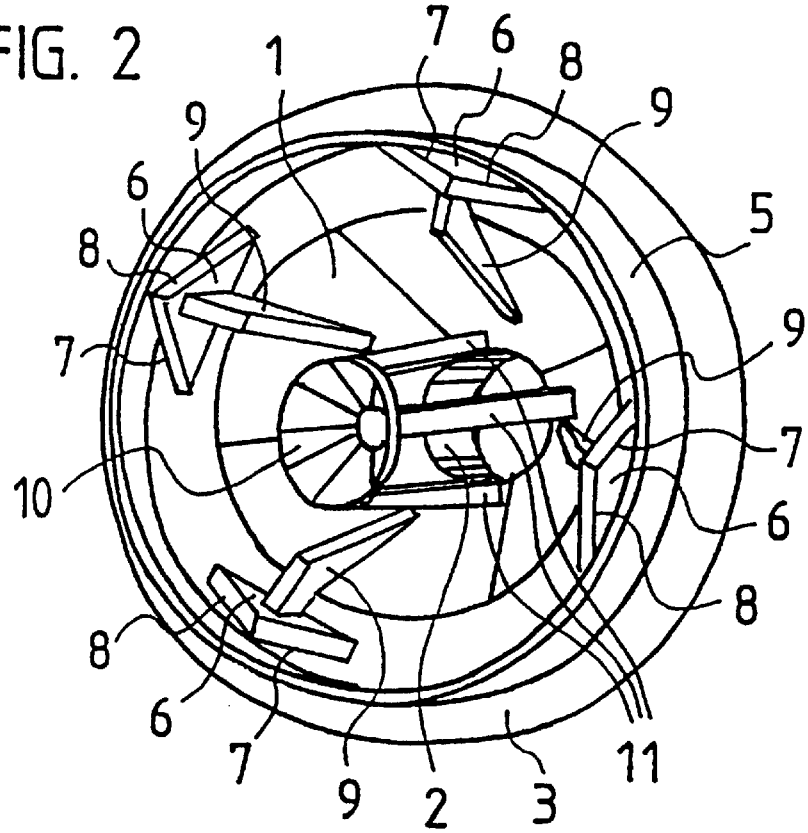
FIG. 2 is a perspective representation of the disposable self-opener viewed inclined toward its interior.

FIG. 2 shows a perspective representation of the self-opener with an inclined view of its interior. On the outside, the flat shoulder 3 can be viewed from the back side. Said shoulder is adjoined by an annular wall 5. In the present embodiment, the four pairs of cutting edges 6 are located within the annular wall 5. Said pairs of cutting edges each comprise the two cutting edges 7, 8, which form a gable with each other, whereby the peak of the gable is directed in the screwing direction and the cutting edges run along a secant within the annular wall 5, although they may also be curved. The two cutting edges 7, 8, furthermore, extend with an inclination versus the plane of rotation of the self-opener. The pair of cutting edges 6 is reinforced by means of a holding bridge 9, which is joined with the inner side of the cone 1, forming one piece with the latter. Such an arrangement of the cutting edges 7, 8 assures that said edges pierce the end of the sausage-like cartridge located in the dispenser when the self-opener is screwed onto the end of the dispenser, and cut it open. The self-opener itself needs not to turn for this purpose at all, but it suffices that it is pressed onto the end of the "sausage" in the axial direction as the screw cap is screwed to the end of the "sausage". Because the pairs of cutting edges each form a gable, slits are reliably cut into the foil material of the packaging. Now, according to the invention, in the center, the self-opener comprises a retainer basket 10 acting against the direction of screwing. In the example shown, said basket is resting on the four supports 11, whose feet are molded onto the inner side of the cone 1. The retainer basket 10 serves for receiving the metal clips by which the sausage-like tubular bag cartridge is sealed at its end. The retainer basket 10 itself may be designed in the form of a funnel made of solid material, or it may be a lattice-type basket, or simply a dish. Its shape does not have to be conical but it could be simply designed in the form of a trough as well, or could serve the same function even in the form of a can-like retainer basket with a plane surface and an upwardly cantilevered edge. Instead of having the four supports 11, said retainer basket 10 could be supported also by two or more support elements extending radially in relation to the annular wall 5. Said support elements may be supported on the inner side of the conical tube shoulder 1, or connected with the inner side of the annular wall 5 in a cantilevered manner as well, and support the retainer basket 10 in the center. However, if the supports 11 are arranged vertically as shown in the drawing, sufficiently high forces of reaction can be raised, and only little resistance is put up at the same time when the pasty compound is squeezed out, passing through the self-opener. The pasty compound pressed toward the device as it is being squeezed out, flows around the retainer basket 10, notably laterally, and subsequently passes through between the supports 11 and is then received in the cone 1 and finally in the orifice 2.

Figure 3:
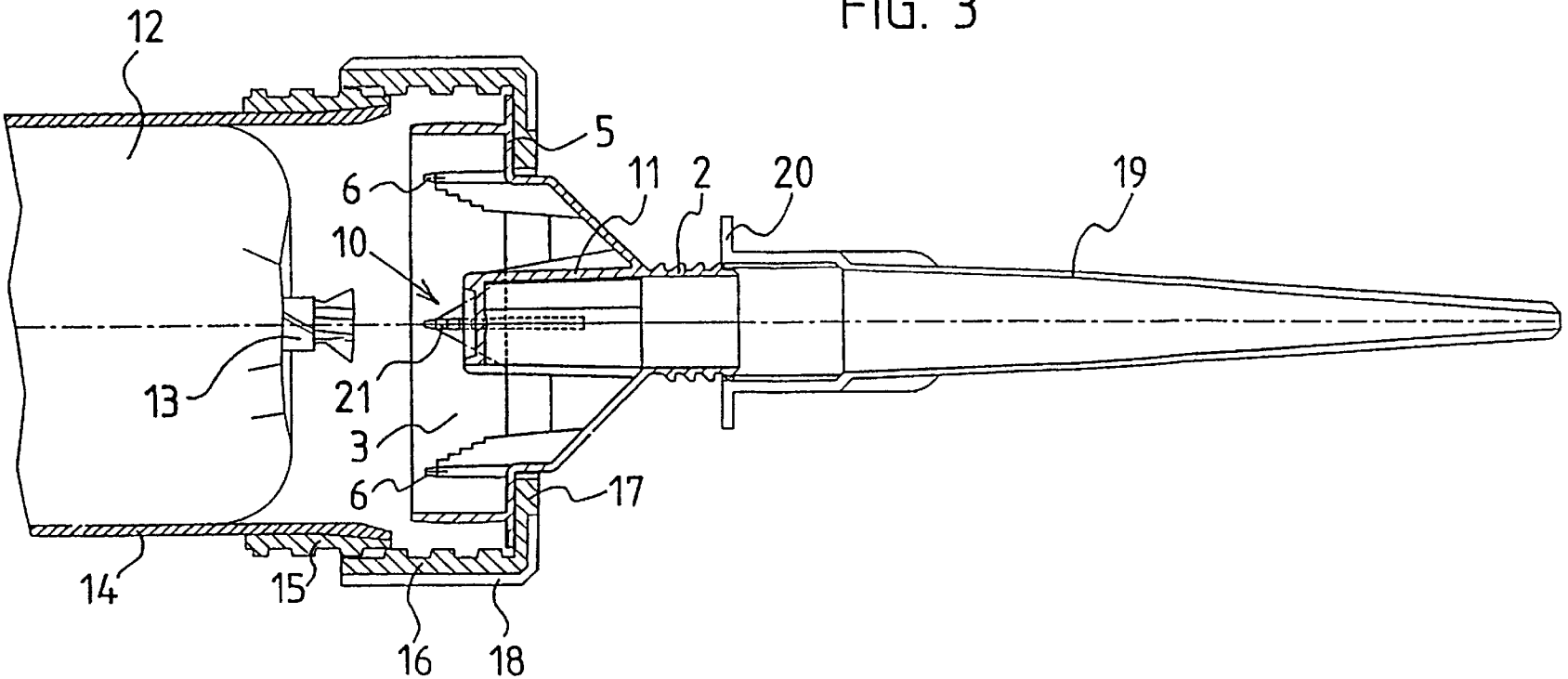
FIG. 3 shows a longitudinal section of the disposable self-opener as it is being mounted on a dispenser.

FIG. 3 shows a longitudinal section of the device as it is being mounted on a dispenser. The sausage-like packaging or tubular bag cartridge 12 containing the pasty compound to be squeezed out is shown in the figure on the left. At the right-hand end, the foil material of the packaging is kept together by a metal clip 13 like a sausage. The dispenser includes a hollow cylinder 14 or tube 14 made of metal or plastic. At its one end, said tube 14 has an outer thread 15 made of plastic, which is laminated or welded to the tube 14. In the present figure, the self-opener is already inserted in the screw cap 16. The screw cap 16 rests on the plane shoulder 3 of the self-opener with its plane cover surface 17. The inside width of the cover surface 17 of the screw cap 16 is dimensioned in such a way that the self-opener can be fitted therein. On the outside, the cap screw 16 may have a coating 18 providing for a positive grip, so that the fingers cannot slip off when it is screwed on, and higher torques can be applied. On its inner side, the self-opener shows the two counter-opposed cutting edge pairs 6 with their holding bridges 9, as well as the surrounding annular wall 5. The retainer basket 10 with its supports 11 is visible in the center of the self-opener. In its center, the retainer basket 10 has a pin 21 pointing in the axial direction. Said pin projects beyond the basket by about the radius of the latter. Said pin is not absolutely required; however, it helps to safely maintain the metal clip 13 in the retainer basket 10 in that it skewers the latter to some extent. The inner sides of the supports 11 are aligned here with the inner side of the orifice 2. A nozzle 19 can be seen plugged over the orifice 2 or welded to the latter.

The shape and length of said nozzle are selected depending on the type of pasty compound. For plugging or screwing the nozzle 19 on, it is provided with a shoulder 20. From the position shown in FIG. 3, the screw cap 16 is screwed onto the end of the tube and takes the self-opener along in the process. The cutting edges of the cutting edge pairs 6 cut the foil of the sausage-like packaging open upon impinging upon said foil.

Figure 4:
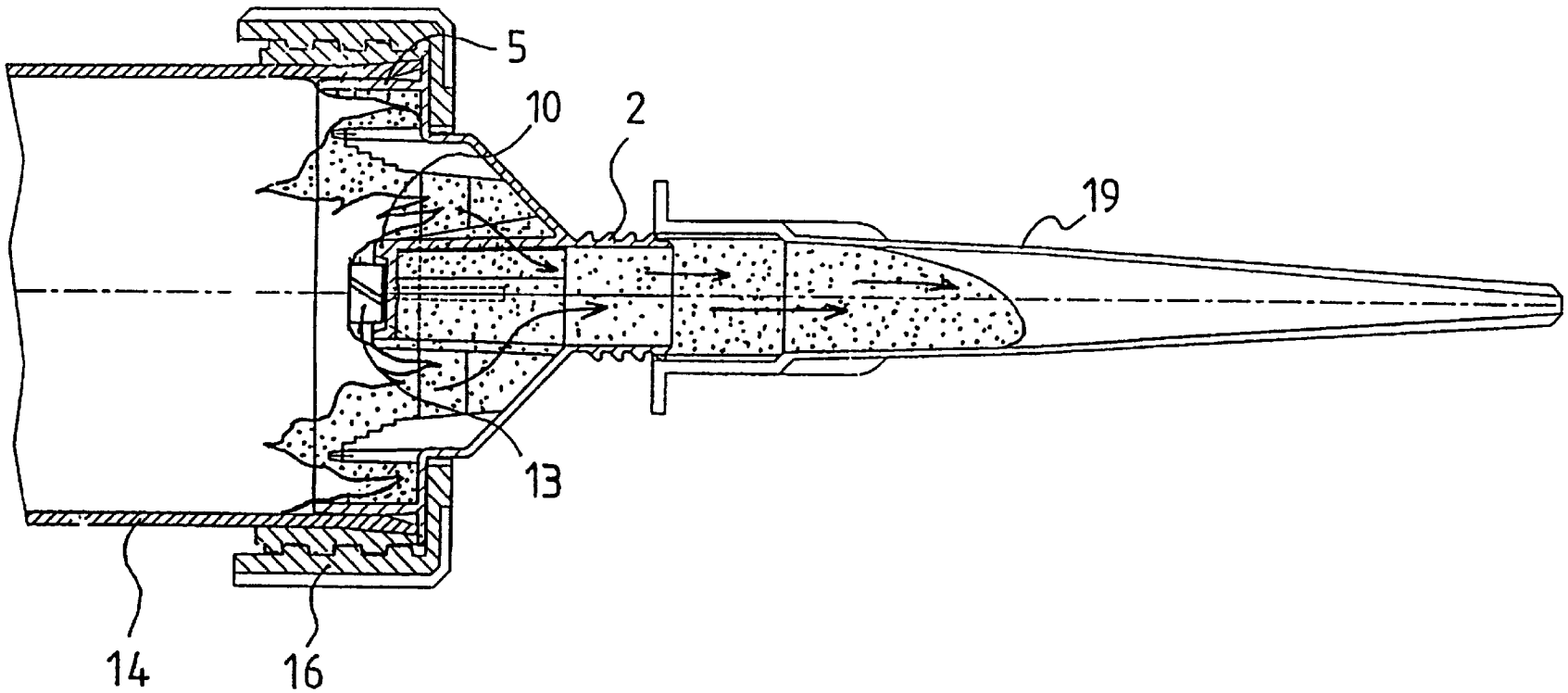
FIG. 4 is a longitudinal section of the disposable self-opener mounted on a dispenser before pressure is applied to the other end of the sausage-like, tubular bag cartridge.

FIG. 4 shows the device complete with the screw cap 16 screwed to the tube end 14 of a dispenser. When in said screwed-on position, the cutting edges on the self-opener have already cut the foil open and the retainer basket 10 has enclosed the metal clip 13 of the sausage-like packaging. The pasty compound oozes out from the slits and, due to the additional pressure admitted via the plunger of the dispenser, has already passed the distance indicated by the drawn arrows. It will finally exit to the outside through the orifice 2 and the attached nozzle 19. The annular wall 5 encloses the end of the "sausage" at the same time and provides for efficient sealing versus the inner wall of the tube 14, so that the latter never comes into contact with outflowing paste and therefore always remains clean.

LIST OF REFERENCE NUMERALS

1 Tube shoulder
2 Orifice
3 Plane shoulder in plane of rotation
4 External thread on orifice 2
5 Annular wall
6 Pair of cutting edges
7 Cutting edge

8 Cutting edge
9 Holding bridges
10 Retainer basket
11 Support for retainer basket
12 Sausage-like tubular bag cartridge
13 Metal clip of sausage-like packaging
14 Hollow cylinder; tube of dispenser
15 External thread of item 14
16 Screw cap
17 Plane cover surface of item 16
18 Sure-grip coating
19 Nozzle
20 Nozzle shoulder
21 Pin on retainer basket

What is claimed is:

1. A disposable self-opener apparatus for opening a tubular bag cartridge and squeezing a pasty composition therefrom, comprising:

a conical tube shoulder having an orifice with said conical tube shoulder being made via a plastic molding procedure;

a screw cap associated with one end of a tube portion of said conical tube shoulder;

a self-opener device screwable with said screw cap for joining said self-opener device with said one end of said tube portion of said conical tube shoulder, said self-opener device having gable-shaped pairs of cutting edges on an inner side with peaks of said gable-shaped pairs of cutting edges pointing in a direction of screwing; and, a retainer basket for receiving a metal clip of a tubular bag cartridge to be opened is centrally located on the inner side of said self-opener device, so that the metal clip does not enter a nozzle attached to the orifice of the conical tube shoulder for dispensing a pasty composition, thereby preventing the metal clip from obstructing a flow of the pasty composition through the nozzle.

2. The disposable self-opener apparatus for opening a tubular bag cartridge according to claim 1, wherein said retainer basket and said gable-shaped pairs of cutting edges are enclosed in an annular wall extending concentrically relative to an axis of rotation of said self-opener device, said annular wall being located on an inner side of said conical tube shoulder.

3. The disposable self-opener apparatus for opening a tubular bag cartridge according to claim 2, wherein said conical tube shoulder is molded onto a plane surface of said conical tube shoulder and disposed in a plane of rotation, with said annular wall located in an inner side of said plane surface.

4. The disposable self-opener apparatus for opening a tubular bag cartridge according to claim 2, wherein said annular wall projects beyond said retainer basket and said gable-shaped pairs of cutting edges in the screwing direction.

5. The disposable self-opener apparatus for opening a tubular bag cartridge according to claim 2, further comprising support elements for supporting said retainer basket, said support elements extending radially in a direction of said annular wall with said support elements resting on an inner side of a conical portion of said conical tube shoulder.

6. The disposable self-opener apparatus for opening a tubular bag cartridge according to claim 2, further comprising support elements for supporting said retainer basket, said support elements extending radially in a direction of said annular wall with said support elements being molded onto said annular wall.

7. The disposable self-opener apparatus for opening a tubular bag cartridge according to claim 1, wherein said retainer basket is mounted on at least two supports extending on an axis of a conical portion of said conical tube shoulder with inner sides of said at least two supports being aligned with an inner side of the orifice of said conical tube shoulder.

8. The disposable self-opener apparatus for opening a tubular bag cartridge according to claim 7, wherein said retainer basket is mounted on three supports extending parallel with the axis of the conical portion, with the inner sides of said three supports being flush with the inner side of the orifice of said conical tube shoulder.

9. The disposable self-opener apparatus for opening a tubular bag cartridge according to claim 7, wherein said retainer basket is mounted on four supports extending parallel with the axis of the conical portion, with the inner sides of said four supports being flush with the inner side of the orifice of said conical tube shoulder.

10. The disposable self-opener apparatus for opening a tubular bag cartridge according to claim 1, wherein said retainer basket is lattice basket opened against the direction of screwing.

11. The disposable self-opener apparatus for opening a tubular bag cartridge according to claim 1, wherein said retainer basket is a dish directed against the direction of screwing.

12. The disposable self-opener apparatus for opening a tubular bag cartridge according to claim 1, wherein said retainer basket is a can directed against the direction of screwing, said can having a plane surface and an upwardly cantilevered edge.

13. The disposable self-opener apparatus for opening a tubular bag cartridge according to claim 1, further comprising a pin protruding beyond said retainer basket in an axial direction, said pin being centrally located in said retainer basket.

* * * * *